United States Patent [19]

Pazzi

[11] Patent Number: 4,601,695

[45] Date of Patent: Jul. 22, 1986

[54] MACHINE AND METHOD FOR THE AUTOMATIC FOLDING OF CLOTHS

[76] Inventor: Fausto Pazzi, Via Rosmini, 13, 63039-San Benedetto del Tronto, Italy

[21] Appl. No.: 597,428

[22] Filed: Apr. 6, 1984

[51] Int. Cl.[4] ..... B65H 45/14; B31B 7/00

[52] U.S. Cl. ..... 493/418; 493/419

[58] Field of Search ..... 493/419, 418, 417, 10, 493/23, 421, 420

[56] References Cited

U.S. PATENT DOCUMENTS

| | | | |
|---|---|---|---|
| 2,699,331 | 1/1955 | McGarvey et al. | 493/421 |
| 3,252,700 | 5/1966 | Henry | 493/418 |
| 3,260,518 | 7/1966 | Kamberg et al. | 493/418 |
| 3,419,261 | 12/1968 | Sjostrom | 493/418 |
| 3,485,491 | 12/1969 | Weir | 493/419 |
| 3,578,311 | 5/1971 | Wood et al. | 493/418 |
| 3,749,394 | 7/1973 | McCain et al. | 493/444 |
| 4,073,486 | 2/1978 | Kober | 493/418 |
| 4,234,179 | 11/1980 | Weir | 493/14 |

*Primary Examiner*—Francis S. Husar
*Assistant Examiner*—William E. Terrell
*Attorney, Agent, or Firm*—Leonard Bloom

[57] ABSTRACT

A method and machine for folding of foldable articles such as cloth, linens, etc., which is capable of performing various different types of folds in any article regardless of the dimensions of the article. When utilized in combination with a second identical machine and a conveyor to carry the article from a first machine to a second machine, in a direction on the same horizontal plane as, but perpendicular to, that of the first machine, this invention is capable of producing transversal, as well as horizontal, folds without having to dismantle or otherwise alter the structures of the machines.

9 Claims, 6 Drawing Figures

MACHINE AND METHOD FOR THE AUTOMATIC FOLDING OF CLOTHS

FIELD OF THE INVENTION

The present invention relates to folding machines, and more particularly to folding machines of the type utilized in the linen, cloth and laundry industries.

BACKGROUND OF THE INVENTION

There are a variety of machines, well known in the prior art for the folding of linen and textiles. However, all of these machines are limited in their scope and application. Some machines are of such a large size and complexity as to be costly and unweldly. Some possess the capability only to fold articles of a particular size and dimension. Finally, the machines of the prior art, of which I am aware, are limited in that they are capable of performing only one type of fold without having to substantially alter their structure or operation.

Such limitations are inconvenient, especially in the linen and laundry industries. Folding machines employed in such industries should ideally be (1) capable of folding articles of all sizes and dimensions; (2) capable of performing various different types of folds, be they lengthwise or transversal without having to dismantle or otherwise alter its structure and (3) of such a size and shape as occupy a minimum of floor area and room volume. There remains a need for a folding machine which possesses such characteristics.

SUMMARY OF THE INVENTION

Accordingly, it is an object of the present invention to alleviate the disadvantages and deficiencies of the prior art by providing a folding machine which utilizes minimal floor space and room volume, can fold linen of any dimensions with a various number of folds, be they lengthwise or transversally.

It is another object of this invention to provide a folding machine where the type of fold desired can be changed without dismantling or otherwise altering its structure.

It is yet another object of this invention to provide a folding machine capable of folding linens of any dimensions with various numbers of folds, be they lengthwise or transversally composed of a minimum number of components of low cost, which is both desirable and efficient in operation.

In accordance with the teachings of the present invention, a machine is provided which, utilizing a minimal floor space and room volume can fold linen of any dimensions in a various number of desired ways using a various number of folds, be they lengthwise or transversal, without having to dismantle or otherwise alter its structure.

In one preferred embodiment, a machine is provided for the folding of foldable articles which includes a first conveyor means for the moving a foldable article on a substantially horizontal plane. A first drive means is provided for driving the first conveyor means in one direction longitudinally thereof. A guide comb is disposed at the end of the first conveyor means for receiving the foldable article therefrom. At least one first nip roller is arranged on a horizontal axis positioned substantially close to the guide comb for receiving the foldable article from the guide comb and moving the article in substantially the one direction. A first retractable bridge is positioned beyond the first nip roller. This first retractable bridge has two positions: an extended first position wherein the bridge is substantially close to the first nip roller, and whereby the article is received from the first nip roller; and, a retracted second position wherein the bridge is substantially away from the first nip roller. A second conveyor means is disposed on a substantially horizontal plane for receiving the article from the first retractable bridge when said bridge is in its extended first position. The space between the first retractable bridge in its retracted second position, the first nip roller, and the second conveyor means forms a first fold gap. Means are provided for retracting the first retractable bridge away from the first nip roller, whereby the foldable article falls downwards into the first fold gap, thereby forming a first fold in the article. A second nip roller is arranged on a horizontal axis. It is positioned beyond the first roller and below the first fold gap whereby the first and second nip rollers grip the article for continued downward movement thereof. A second retractable bridge is positioned below the first and second rollers. The second retractable bridge has two positions: an extended first position, wherein it is substantially close to the second nip roller, whereby the article is received from the first and second nip rollers and guided on the surface of the second retractable bridge in a substantially downward direction; and, the second retractable bridge further having a retracted second position wherein it is substantially away from the second nip roller. A third nip roller is arranged on a horizontal axis. It is positioned substantially below the second nip roller and the second retractable bridge. The third nip roller, the second retractable bridge in its retracted second position, and the second nip roller form therebetween a second fold gap. Means are provided for retracting the second retractable bridge away from the second nip roller whereby the folded article is received in the second fold gap. There the article is gripped by the second and third nip rollers and moved in a substantially horizontal direction thereby forming a second fold in the article. A third conveyor means for receiving the article therefrom and moving the article on a substantially horizontal plane is disposed substantially close to the third nip roller. The article is then driven in the one direction longitudinally thereof by the first drive means whereby the article is removed from the machine.

When an article is desired to be folded in a particular manner, the operator of the instant device merely needs to place the articles to be folded on the first conveyor means. At the end of the first conveyor means, the article is received by the guide comb and guided over it in the substantially same direction as before.

At the end of the guide comb, the article is gripped by the first nip roller which continues to move it in a substantially forward direction. If a fold is desired at that location, the drive means of the first retractable bridge will drive said bridge into its fully extended first position. In this first position it will receive the article from the first nip roller on its surface and will guide said article over the first fold gap. If the article is long enough, it will also be received by the second conveyor means which will aid in moving and guiding the article. Depending on where the desired fold is to be, the second drive means will stop the forward movement of the second conveyor means, and place it in a stationary position while the first conveyor means continues to move in its substantially forward position. The drive means for the first retractable bridge will cause the bridge to retract, causing the article to move downwards into the first fold gap. There the article is gripped by the first and second nip rollers which continue to move the article downwards thereby forming a first fold in the article.

If at that location no fold is desired, the drive means of the first retractable bridge will drive said bridge into its retracted second position. In that position it is substantially away from the first nip roller whereby the article now moves downwards into the first fold gap. There it is gripped by the first and second rollers which continue to move it in a downwards direction.

If an additional fold is now desired, the drive means of the second retractable bridge will drive the bridge to its extended first position. In this position the second retractable bridge can receive the article from the first and second nip rollers on its surface and guide said article over the second fold gap. Then at a desired time, the drive means for the second retractable bridge will cause said bridge to retract, thereby causing the article to move into the second fold gap. There it is gripped by the second and third nip rollers which now move the article in substantially the one direction again. In this manner, the additional fold is made and the folded article is received by the third conveyor means which carries it from the machine.

If this second fold is not desired, the drive means of the second retractable bridge will drive it into its retracted second position. In this position, the bridge is substantially away from the second nip roller, whereby the article now moves freely into the second fold gap. There the article is gripped by the first and second nip rollers which now move it in substantially the one direction again. The folded article is then received by the third conveyor means which carries it from the machine.

In a preferred embodiment of this invention, a means for controlling the forward movement of the second conveyor means and the operation of the first and second retractable bridges is provided. This means, in combination, is comprised of an electronic measuring means for measuring the distance of travel of said article, a preset program and a manual push button selector means for selecting a desired program. The electronic measuring means is disposed below the first conveyor means.

In accordance with the further teachings of the present invention, an additional, first nip roller can be provided, arranged on its own horizontal axis. It is further positioned in substantially the same vertical plane as the first nip roller at the end of the guide comb. There it aids in receiving the foldable article from the guide comb and forms a gripping action with the first nip roller to aid in moving the article in the substantially one direction.

In accordance with the further teachings of this invention, a thin tubular duct, on a horizontal axis, perforated along a generating line, is provided immediately above each of the fold gaps. There, at the appropriate moment, as the bridges are retracted, compressed jets of air are expelled from the generating line and into the fold gap. These jets of air aid in the folding of the article.

And in still further accordance with the teachings of the present invention, the machine is provided with a first retractable bridge being of a flat rake design, and a second retractable bridge comprised of a slide end, positioned substantially away from the second nip roller, and further having on the opposite side thereof, flat teeth of a rake said side being positioned substantially close to the second nip roller, and a plurality of U-shaped notches, regularly spaced in the upper edge of the slide end whereby the flat teeth of the rake may be driven forward into the aforesaid notches when said second retractable bridge is in its extended first position. The drive means for both the first and second retractable bridges being provided by their own hydraulic rams.

In another embodiment of the instant invention is provided a machine capable of folding articles along transverse as well as longitudinal lines. This machine is comprised of two of the machines of the beforementioned preferred embodiment in combination with a fourth conveyor means for the moving of the foldable article on a substantially horizontal plane at a substantially 90° angle from the forward one direction. This fourth conveyor means is disposed on one end of the third conveyor means of the first machine whereby it receives articles from said third conveyor means. It is further disposed on its other end at the entrance to the first conveyor means of the second machine whereby articles are received from the fourth conveyor means by the first conveyor means of the second machine. A drive means for the fourth conveyor means is also provided.

This arrangement provides for a machine wherein both longitudinal, as well as traverse folds may be made in the article without having to dismantle or otherwise alter the machine's structure.

These and other objects of the present invention will become apparent from a reading of the following specification taken in conjunction with the enclosed drawings.

DESCRIPTION OF THE PREFERRED EMBODIMENT

Figure 1:
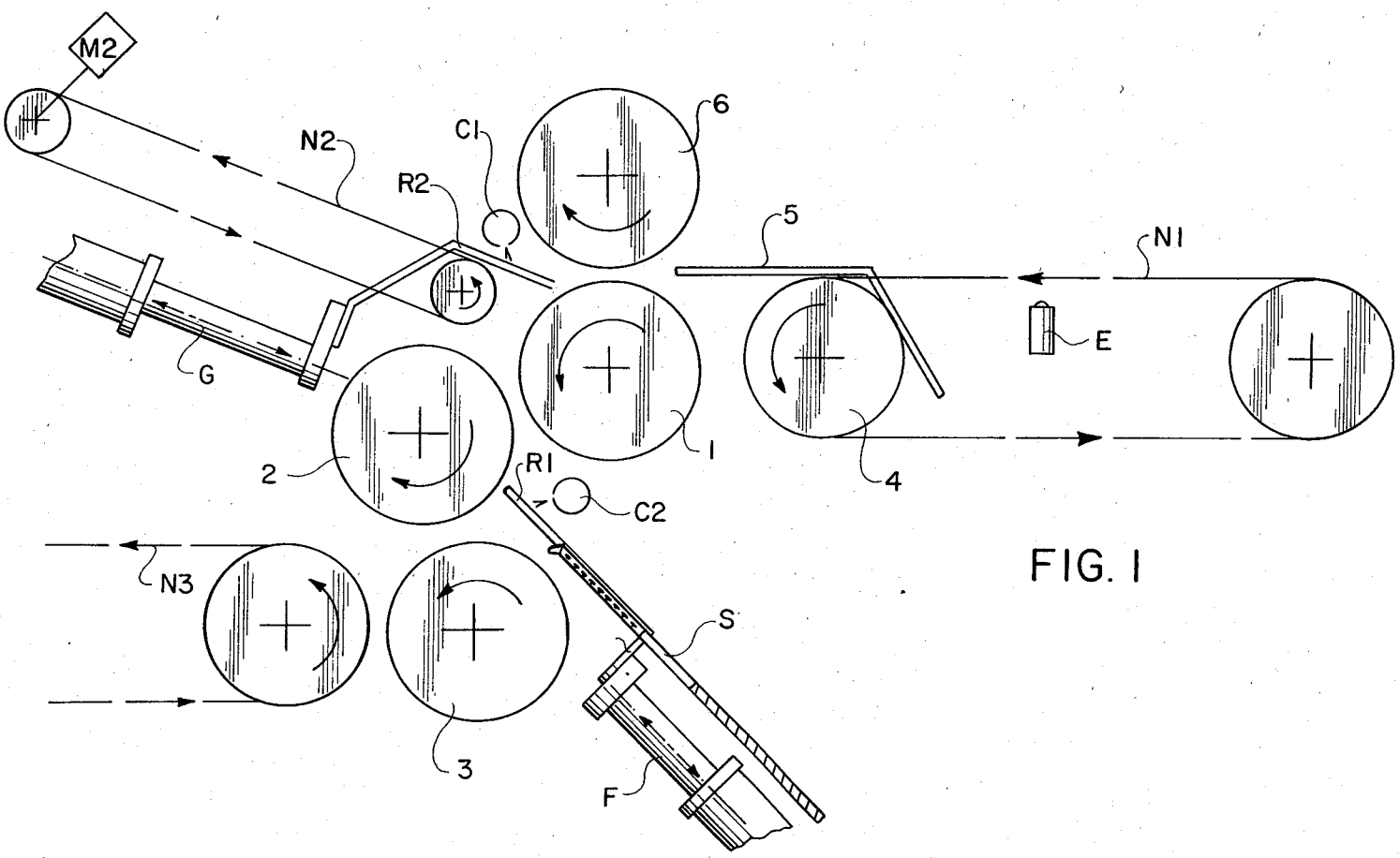
FIG. 1 is a schematic illustration, in side view and in a direction parallel to the longitudinal axis of the rollers, of the members present in the preferred embodiment of the invention.
Figure 4:
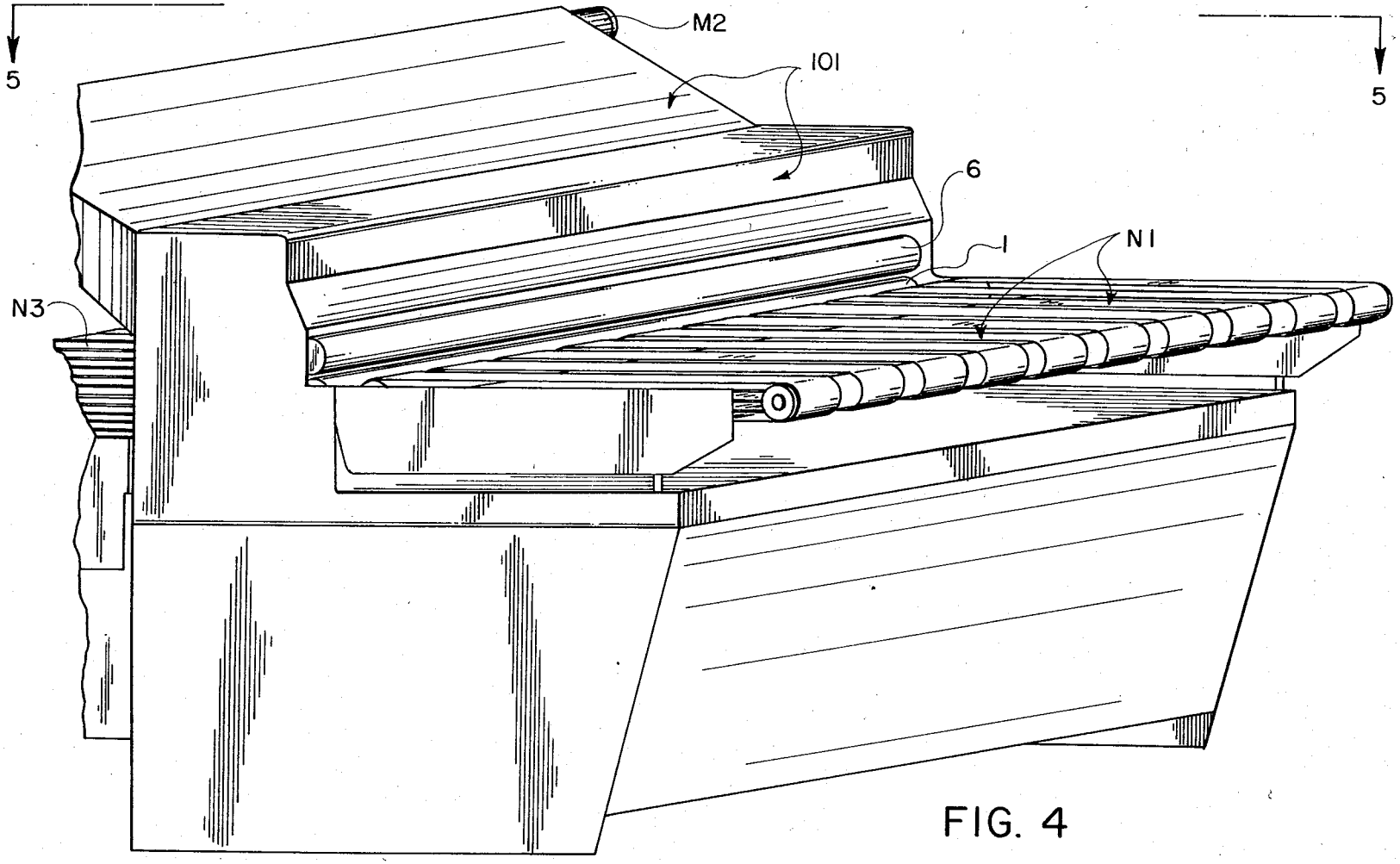
Figure 5:
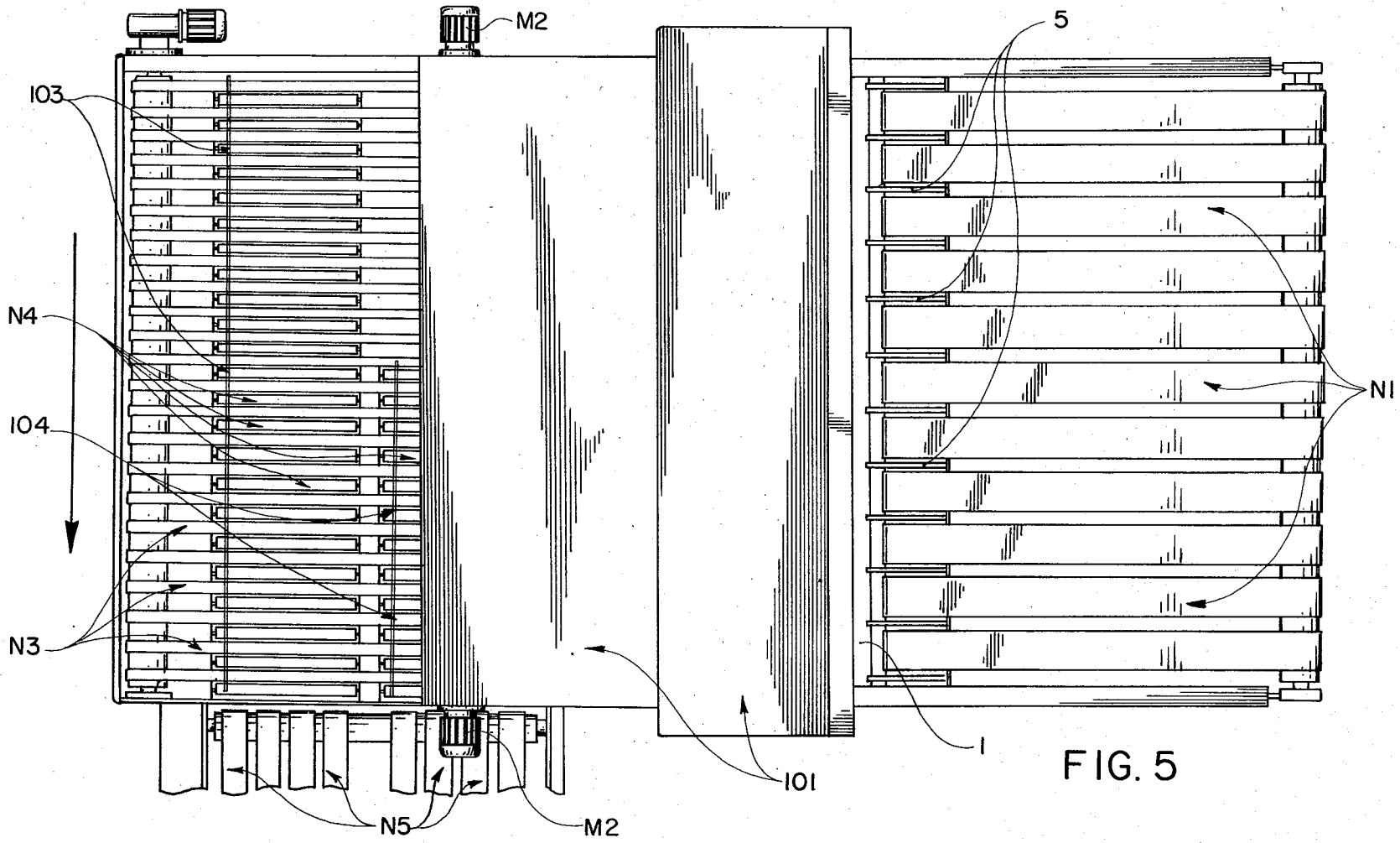
FIGS. 5 and 6 are a schematic illustration, taken along the lines 6—6 of FIG. 3, and the lines 5—5 of FIG. 4, which for reasons of space, has been divided and set out in two different figures.
Figure 6:
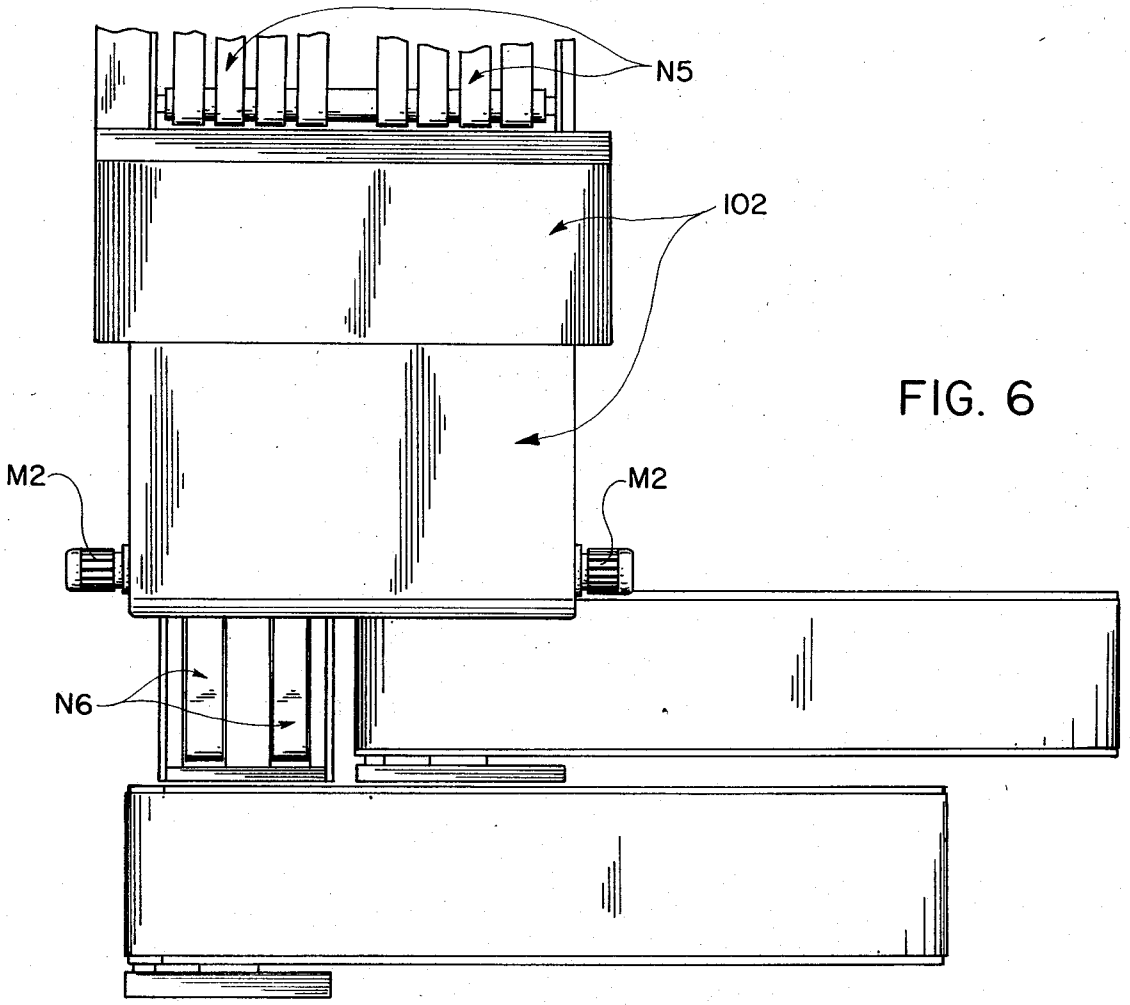

With reference to FIG. 1, the preferred embodiment of the invention is shown. The essential features of the construction of the invention can probably best be illustrated by describing the operation of the equipment relative to the individual pieces therein as follows:

A first conveyor means N1 is provided. In the preferred embodiment, this conveyor means is comprised of a plurality of parallel endless bands of material placed in close proximity to one another. These bands are supported for rotation with their upper surfaces adapted to move in the forward direction indicated by the arrows. These bands are mounted on rollers 4 which are suitably journaled in the frame of the conveyor. The bands of this preferred embodiment are probably best illustrated by reference to FIGS. 4 and 5.

The drive means provided for driving the first conveyor means N1 in one direction longitudinally is not pictured.

A guide comb 5 is disposed at the end of the first conveyor means N1. In the preferred embodiment, this guide comb 5 is constructed of one piece, is angularly shaped and is positioned so that one end of said guide comb 5 is substantially parallel to the first conveyor means N1 with the other end of said guide comb 5 angled substantially in the direction of the first conveyor means so as to angularly protrude downward through the spaces between the bands of the first conveyor means N1. The guide comb 5 receives the article from the first conveyor means N1 and guides it in substantially the same direction.

In the preferred embodiment, a pair of first nip rollers 1 and 6 are provided to receive articles from the guide comb 5. In this embodiment both nip rollers 1 and 6 are arranged on their individual horizontal axes and are suitably supported for rotation and journaled in the frame (not shown). Nip roller 6 is positioned immediately above the guide comb 5. Nip roller 1 is positioned immediately below the guide comb 5. These nip rollers 1 and 6 receive the article from the guide comb 5, and gripping said article, continue to move it in its substantially forward direction.

While the preferred embodiment of FIG. 1 is provided with a pair of first nip rollers 1 and 6, it is to be understood from the teachings of this invention that the first nip roller 6 is not required for the operation of this machine. The presence of the nip roller 1 in the position described above is sufficient in and of itself to carry out the function of moving the article in its substantially forward direction.

If one desires to make a double fold, a first retractable bridge R2 is provided as shown in FIG. 1, in its extended position.

In this position it is substantially close to nip roller 1 whereby it can receive the article and support and guide it over a first fold gap to the second conveyor means N2.

It is to be understood that in the preferred embodiment, the end of this bridge R2, positioned toward the nip roller 1 is in the shape of a flat tooth rake (not shown). This structure aids the first retractable bridge to receive the article when it is extended. This rake structure is not required.

This first retractable bridge R2 is driven by a drive means G.

A second conveyor means N2 is provided with an upper surface adapted to receive the article thereon and to move it in the forward direction indicated by the arrows. This conveyor means N2 is supported by forward and rear rollers suitably supported for rotation and journaled in the frame. This second conveyor means N2 is driven by its own drive means M2 which is independent of all other drive means.

It is to understood that while, in the preferred embodiment of the invention depicted in FIG. 1, the second conveyor means is shown to be positioned angularly in relation to the first conveyor means N1, constant with the teachings of this invention, said second conveyor means N2 can be disposed in any angle which is substantially parallel to the horizontal plane of the machine.

A first fold gap is defined by the space between the first nip roller 1, the second conveyor means N2, and the first retractable bridge R2 in its retracted second position.

An air duct C1 is provided in the preferred embodiment of FIG. 1. This duct is disposed on a horizontal axis and is perforated along a generating line (not shown) and positioned near the first fold gap whereby at a preset moment, jets of compressed air are released from the perforations of the aforesaid generating line into the first fold gap. It is to be understood that while this air duct is not required for the proper operation of this invention, it is preferable in that it aids in the folding of the article.

When, at a moment one desires a fold in the article, the second conveyor means N2 is stopped in its forward movement. The first retractable bridge R2 is driven by a drive means G from its extended first position into its retracted second position, and compressed air is simultaneously released from air duct C1 as described above. When the aforesaid occurs, the article is permitted to move downwards into the first fold gap whereby it is folded and gripped by the first nip roller 1 and a second nip roller 2, which continue to move the folded article in a downwards direction.

The second nip roller 2 is disposed on a substantially horizontal axis beyond the first nip roller 1 and below the first fold gap. The second nip roller 2 is suitably mounted for rotation about its axis and is journaled in the frame of the machine.

If one desires to make but a single fold in the article, the first retractable bridge R2 will be disposed in its retracted second position whereby the unfolded article is permitted to pass directly from the first nip rollers 1 and 6 towards the first fold gap. Therein it is gripped by the first nip roller 1 and the second nip roller 2, whereby the unfolded article is continued to be moved in a downwards direction.

A second retractable bridge R1 is provided. This bridge R1 is disposed below the first nip roller 1 and the second nip roller 2. As shown in FIG. 1, the second retractable bridge R1 is illustrated in its fully extended first position. This is the position desired when one desires an additional fold to be made in the article.

It is to be understood that, in the preferred embodiment of the invention, the second bridge means has an end, substantially away from the second nip roller 2, which comprises a slide S. The upper edge of this slide is provided with a plurality of U-shaped notches, regularly spaced into which fit the flat teeth which may also be provided on that side of the second retractable bridge R1 which is substantially near the second nip roller 2.

In its extended first position, as illustrated in FIG. 1, the second retractable bridge R1 is positioned substantially close to the second nip roller 2. This bridge is driven by a drive means F. In this position, the second retractable bridge R1 is designed to receive the article from nip rollers 1 and 2 and is further designed to support and guide the article over a second fold gap (described below) to a slide S.

A third nip roller 3 is also provided. This roller 3 is arranged on a substantially horizontal axis and positioned substantially below the second nip roller 2 and the second retractable bridge R1. It is suitably supported for rotation about its own axis and journaled in the frame of the machine.

The second fold gap is defined by the second and third nip rollers 2 and 3 respectively and the second retractable bridge R1 in its retracted second position.

An air duct C2 is provided in the preferred embodiment of FIG. 1. This duct is disposed on a horizontal axis. It is perforated along a generating line (not shown) and positioned near the second fold gap whereby at a preset moment jets of compressed air are released from the perforations of the aforesaid generating line into the second fold gap.

It is to be understood that while this air duct C2 is not required for the proper operation of this invention, it is preferable in that it aids in folding the article.

When, at a moment one desires an additional fold, the second retractable means R1 is driven by a drive means F from its extended first position into its retracted second position and compressed air is simultaneously released from air duct C2 as described above. When the aforesaid occurs, the article is permitted to move in a substantially horizontal direction into the second fold gap whereby it is folded an additional time and gripped by the second nip roller 2 and the third nip roller 3 which continues to move the folded article in a substantially horizontal direction.

If one does not desire an additional fold in the article, the second retractable bridge R1 will be disposed in its retracted second position whereby the article is permitted to pass directly from the nip rollers 1 and 2 into the second fold gap wherein it is gripped by the nip rollers 2 and 3 and moved in a substantially horizonal direction.

Figure 3:
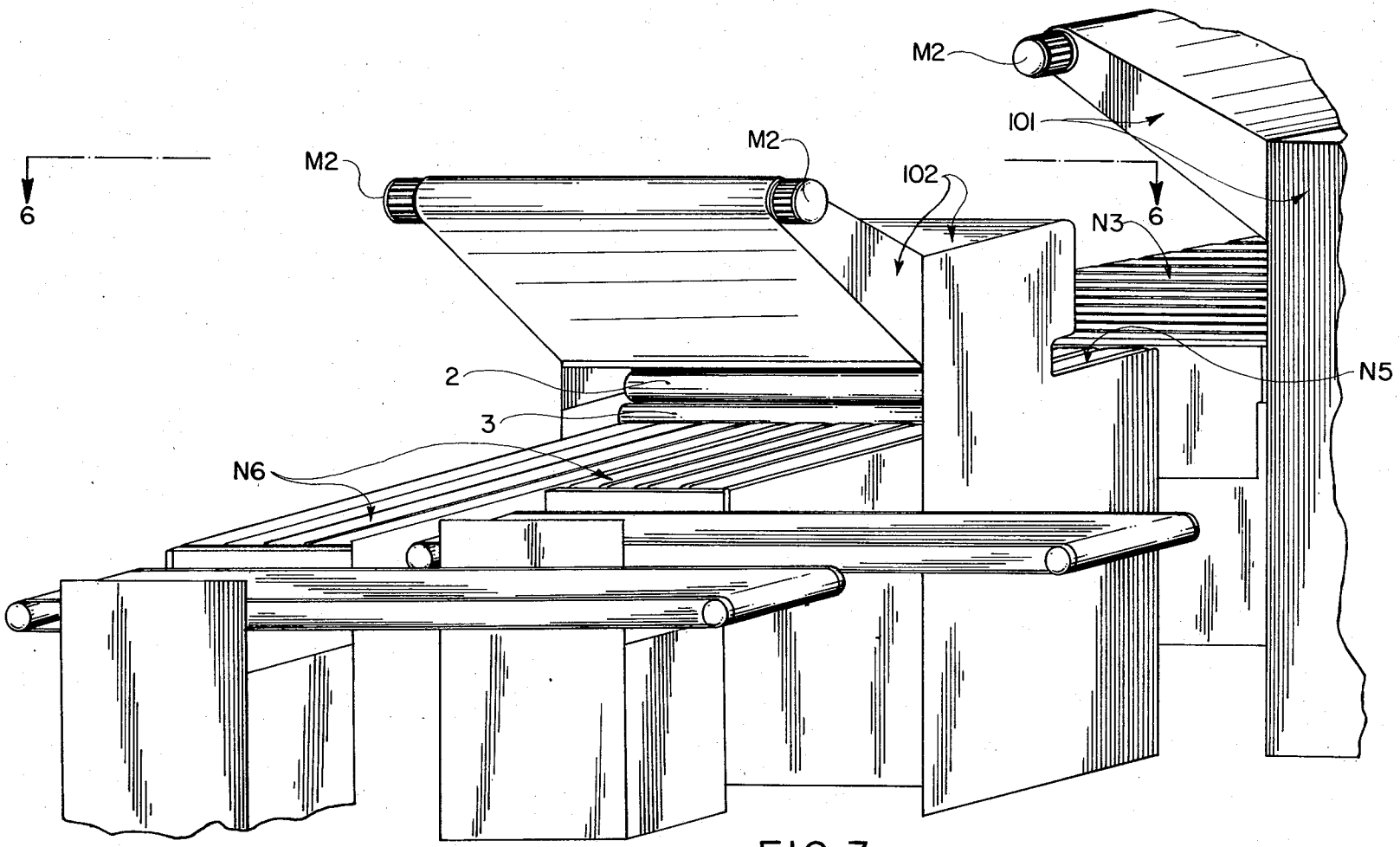
FIGS. 3 and 4 are a schematic illustration, in side view, of another preferred embodiment of the instant invention, which for reasons of space, has been divided and set out in two different figures.

Finally, a third conveyor means N3 is provided. This conveyor means N3 is positioned on a substantially horizontal plane substantially close to the third nip roller 3 whereby it receives the article from the third nip roller 3. In the preferred embodiment of this invention, this third conveyor means is comprised of a plurality of parallel endless bands of material placed in close proximity to one another. These bands are supported for rotation with their upper surfaces adapted to move in a longitudinal direction as indicated by the arrows whereby they carry the folded article from the machine. These bands are mounted on rollers, only one of which is seen in FIG. 1. Both rollers are suitably journaled in the frame. This is perhaps most clearly depicted in FIGS. 3 and 5.

In a Preferred Embodiment, the operation of the machine in general, and, in particular, of the first and second retractable bridges R2 and R1 respectively, the two air ducts C1 and C2 and the forward movement of the second conveyor means N2 is controlled by an electronic measuring means E, a preset program and a manual push button selector (both not depicted). This control is achieved by a program to control the operation depending on the dimension of the article to be folded and the fold desired. Before commencing operation, the appropriate program is selected by use of the manual push button selector means. Disposed below the first conveyor means N1, the electronic measuring means E measures the distance of travel of the article therealong. This combination is connected to said second conveyor means N2, air ducts C1 and C2, and the retractable bridges R1 and R2, whereby said combination controls their operation.

Figure 2:
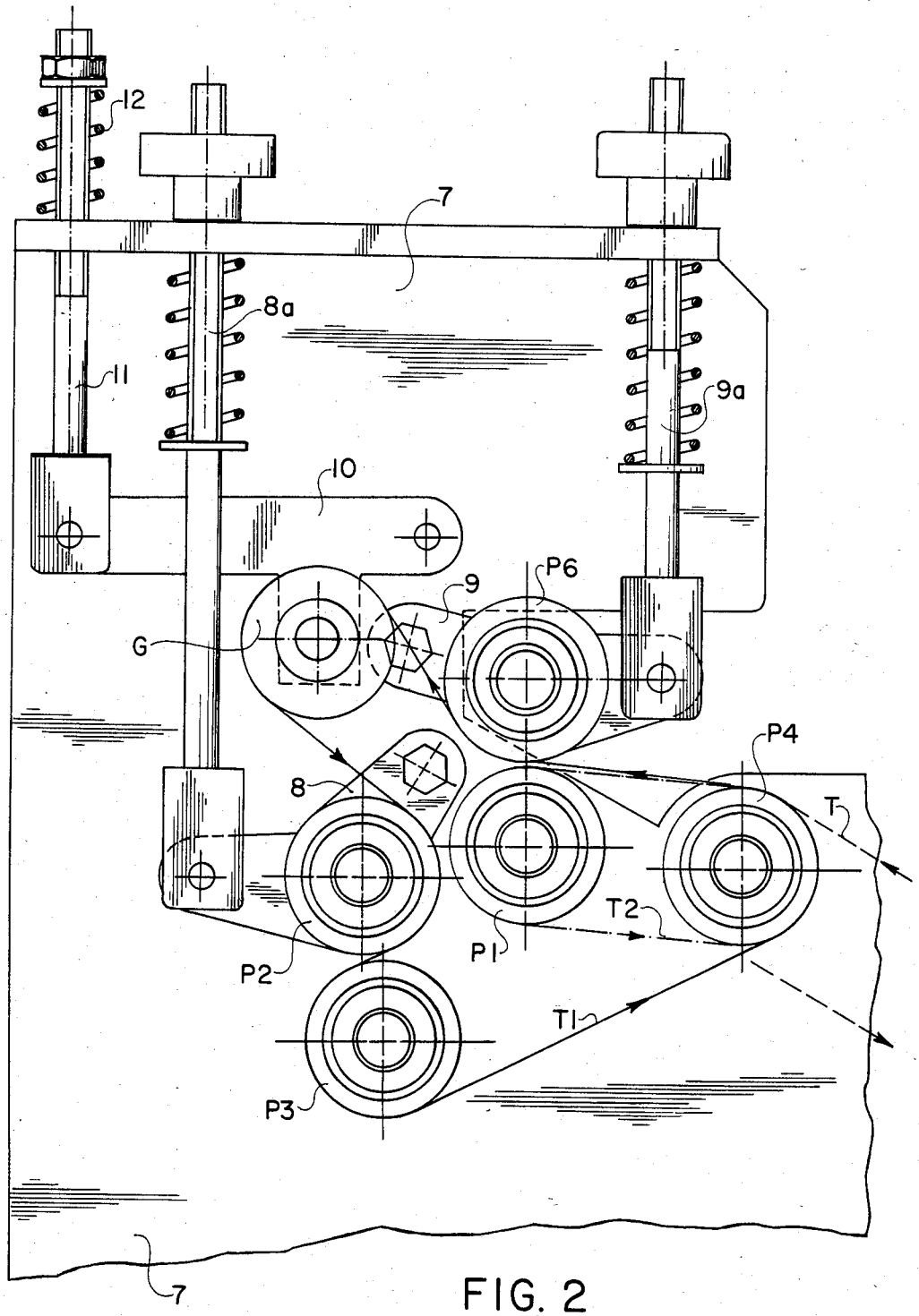
FIG. 2 is a schematic illustration, in side view and in a direction parallel to the longitudinal axis of the roller of the support members of each nip roller and the drive system employed in the preferred embodiment of the instant invention.

Referring now to FIG. 2, therein is illustrated the drive motion of the preferred embodiment. There is shown in FIG. 2, one of two lateral support plates 7 of the machine. A driving pulley P4, which drives nip roller 4 is rotatably journaled in the frame 7. Said driving Pulley P4 carries a sprocket which, by toothed chain, is connected to the main motor (not shown). Another sprocket is provided on pulley P4 which, by toothed chain, drives pulleys P3, P2, P6 and P7, which respectively, drive the nip rollers 3, 2, 6, and 1. Pulley P1 is also driven by pulley P4 through use of a separate toothed chain T2. This operation occurs independently of the others.

It should be noted that pulleys P2 and P6 are held respectively on the ends of two support arms 9 and 8 which are both hinged to lateral support plate 7. Two threaded support rods 8A and 9A, which are cushioned, are also provided. These rods are provided in order to regulate the distance between the centers of nip rollers 1 and 6 on the one side, and the pair of rollers 2 and 3 on the other side, depending on the thickness of the article to be folded.

FIG. 2 also depicts a jockey pulley G supported by a ball crank lever 10. This ball crank lever 10 is hinged to plate 7 and is supported by a threaded rod 11 bearing a shock absorber spring 12.

With reference to FIGS. 3–6 a second preferred embodiment of the present invention is illustrated wherein the two separate machines of the type referred to in FIGS. 1 and 2 are combined at right angles to each other in such a matter that transverse, as well as longitudinal folds can be performed.

The machine 101 of FIGS. 1 and 2 is provided. In this embodiment, the third conveyor means N3 of the first machine 101 is comprised of a plurality of endless bands of material placed in close proximity to one another. These bands are supported for rotation with their upper surfaces adapted to move in the forward one direction. These bands are mounted on rollers which are journaled in the frame.

After being folded in machine 101, the article is carried by the third conveyor means N3. Beneath the third conveyor means another, fourth conveyor means N4, is disposed. This fourth conveyor means N4 is driven in a horizontal direction substantially perpendicular to that of the third conveyor means N3. As can best be seen in FIG. 5 the fourth conveyor means N4 is comprised of a series of support rollers supported by a mobile frame 104 which may be raised so that the rollers of said fourth conveyor means N4 protrude through the spaces existing between the bands of the third conveyor means N3. These rollers are supported for rotation and are journaled in the frame 104 and adapted to move in the forward direction indicated by the arrows of FIG. 5. The third conveyor means N3 carries the folded articles until they are received by the rollers of the fourth conveyor means N4, whereby the rollers of the fourth conveyor means N4 receives the article and carries it to a fifth conveyor means N5, of a second machine 102. This fifth conveyor means N5 is identical to the first conveyor means N1 and which feeds the articles into said second machine 102. This second machine 102 is identical to the first machine 101 and therefor makes folds in the article perpendicular to those made by the first machine 101.

According to this preferred embodiment of the instant invention, the following combinations of folds can be made:

1. A longitudinal fold and a transversal fold;
2. A longitudinal fold and two transversal folds;
3. Two longitudinal folds and transversal fold;

4. Two longitudinal folds and two transversal folds;
5. A longitudinal fold;
6. Two longitudinal folds;
7. A transversal fold; and
8. Two transversal folds.

While the preferred embodiment of this invention has thus been illustrated and described, it is to be understood that such showing and description have been offered by way of example and not limitation. Variations will be apparent to one skilled in the art without departing from the principles described herein. Accordingly, the invention is not limited to the specific embodiment illustrated. Protection by Letters Patent of this invention, in all its aspects as the same are set forth in the appended claims, is sought to the broadest extent that the prior art allows.

I claim:

1. A machine for the folding of foldable articles comprised of a first conveyor means for the moving of a foldable article on a substantially horizontal plane, a first drive means for driving the first conveyor means in one direction longitudinally thereof, a guide comb disposed at the end of the first conveyor means for receiving the foldable article therefrom, at least one first nip roller arranged on a horizontal axis positioned substantially close to the guide comb for receiving the foldable article from the guide comb and moving the article in substantially the one direction, a first retractable bridge positioned beyond the first nip roller and having an extended first position wherein the bridge is substantially close to the first nip roller, whereby the article is received from the first nip roller, and having a retracted second position wherein the bridge is substantially away from the first nip roller, a second conveyor means disposed on a substantially horizontal plane for receiving the article from the first retractable bridge when said bridge is in its extended first position, the space between the first retractable bridge in its retracted second position, the first nip roller and the second conveyor means forming a first fold gap, means for retracting the first retractable bridge away from the first nip roller whereby the foldable article falls downwards into the first fold gap, thereby forming a first fold in the article, a second nip roller arranged on a horizontal axis, beyond the first roller and below the first fold gap, whereby the first and second nip rollers grip the article for continued downward movement thereof, a second retractable bridge positioned below the first and second rollers and having an extended first position wherein it is substantially close to the second nip roller, whereby the article is received from the first and second nip rollers and is guided on the surface of the second retractable bridge in a substantially downward direction, the second retractable bridge further having a retracted second position wherein it is substantially away from the second nip roller, a third nip roller arranged on a horizontal axis and positioned substantially below the second nip roller and the second retractable bridge, the third nip roller, the second retractable bridge in its retracted second postion and the second nip roller forming therebetween a second fold gap, means for retracting the second retractable bridge away from the second nip roller, whereby the folded article is received in the second fold gap and is gripped by the second and third nip rollers and moved in a substantially horizontal direction, thereby forming a second fold in the article; and a third conveyor means for receiving the article therefrom and moving the article on a substantially horizontal plane disposed substantially close to the third nip roller and driven in the one direction longitudinally thereof by the first drive means, whereby the article is removed from the machine.

2. The machine of claim 1 wherein an additional, first nip roller is provided, arranged on a horizontal axis, and positioned substantially close to the guide comb for receiving the foldable article therefrom and, in combination with the first nip roller, for gripping and moving the article in the substantially one direction.

3. The machine of claim 1 wherein is provided a first air duct, disposed on a horizontal axis, perforated along a generating line, positioned substantially near the first fold gap whereby, at a preset moment, jets of compressed air are released from the perforations of the aforesaid generating line into the first fold gap; and a second air duct disposed on a horizontal axis, perforated along a generating line positioned substantially near the second fold gap whereby at a preset moment jets of compressed air are released from the perforations of the aforesaid generating line into the second fold gap.

4. The machine of claim 1 wherein the first retractable bridge has a flat rake design and the second retractable bridge is comprised of a slide end, positioned substantially away from the second nip roller, an end having flat teeth of a rake positioned substantially close to the second nip roller and being on the opposite end from the slide end, and a plurality of U-shaped notches, regularly spaced in the upper edge of the slide end, whereby the flat teeth of the rake may be driven forward into the aforesaid notches during said second bridges extended first position.

5. The machine of claim 1, wherein the first drive means is comprised of a first hydraulic ram and the second drive means is comprised of a second hydraulic ram.

6. The machine of claim 1, wherein the third conveyor means comprises a plurality of endless bands of material placed in close proximity to one another and mounted on rollers which are journaled in the frame.

7. A machine for the folding of foldable articles along transverse, as well as longitudinal lines comprised of the combination of a first machine of claim 1, and arranged with a second machine of claim 8, and fourth conveyor means for the moving of a foldable article from the said first machine to the said second machine on a substantially horizontal plane, at a substantially 90° angle from the forward one direction, one end of said fourth conveyor means being disposed at one end at the base of the third conveyor means of said first machine whereby it receives articles therefrom and at the opposite end at the entrance to the first conveyor means of said second machine whereby articles are received from the fourth conveyor means by the first conveyor means of said second machine and a drive means for driving the fourth conveyor means.

8. The machine of claim 7, wherein the fourth conveyor means is comprised of a rectangular frame, a plurality of rollers suitably journaled for rotation on a horizontal axis within said rectangular frame for carrying the article; said fourth conveyor, at one end being disposed under the third conveyor means so that the rollers of the fourth conveyor means protrude through the spaces between the belts of the third conveyor means whereby it receives articles therefrom and moves them on a substantially horizontal plane, at a substantially 90° angle from the forward one direction until it is received from the fourth conveyor means by the first conveyor means of the second machine.

9. A method for folding a foldable article comprising the steps of moving said article on a substantially horizontal plane on a moving first conveyor across the surface of a guide comb and onto the surface of a first nip roller which aids in further moving said article across a first fold gap on the surface of a first retractable bridge toward a second conveyor moving in substantially the same direction as the first conveyor carrying said article on the second conveyor while bridging said gap; stopping the forward movement of the second conveyor while said article is being carried thereby and simultaneously therewith retracting the first retractable bridge and continuing the movement of the first conveyor and first nip roller so that portion where the first fold is desired is permitted to fall downwards into the first fold gap, thereby forming a fold; providing a second nip roller; gripping the folded article between the first and second nip rollers and continuing to move the folded article in a downwardly direction where it is received on the surface of a second retractable bridge and carrying the folded article downwardly across a second fold gap; retracting the second retractable bridge, while continuing the movement of the first and second nip rollers, so that the portion of the article where the second fold is desired is received in the second fold gap; wherein the folded article is gripped by the second nip roller; providing a third nip roller; gripping the folded article by the second and third nip rollers and moving the article in a substantially horizontal direction, thereby forming a second fold; and providing a third conveyor means having a surface for receiving and moving the double folded article from the machine.

* * * * *